US009049769B2

(12) United States Patent
Secilmis

(10) Patent No.: US 9,049,769 B2
(45) Date of Patent: Jun. 2, 2015

(54) LED LIGHT BULB WITH FAILURE INDICATION AND COLOR CHANGE CAPABILITY

(71) Applicant: Seckin Kemal Secilmis, Kirkland, WA (US)

(72) Inventor: Seckin Kemal Secilmis, Kirkland, WA (US)

( * ) Notice: Subject to any disclaimer, the term of this patent is extended or adjusted under 35 U.S.C. 154(b) by 236 days.

(21) Appl. No.: 13/911,441

(22) Filed: Jun. 6, 2013

(65) Prior Publication Data

US 2013/0328482 A1 Dec. 12, 2013

Related U.S. Application Data

(60) Provisional application No. 61/656,522, filed on Jun. 7, 2012, provisional application No. 61/727,730, filed on Nov. 18, 2012.

(51) Int. Cl.

| | |
|---|---|
| ***H05B 41/00*** | (2006.01) |
| ***H05B 37/02*** | (2006.01) |
| ***H05B 33/08*** | (2006.01) |
| ***H05B 37/03*** | (2006.01) |

(52) U.S. Cl.

CPC ..... *H05B 33/089* (2013.01); *H05B 37/03* (2013.01); *H05B 33/0827* (2013.01); *H05B 33/0866* (2013.01)

(58) Field of Classification Search

None

See application file for complete search history.

(56) References Cited

U.S. PATENT DOCUMENTS

| | | | | |
|---|---|---|---|---|
| 8,324,840 | B2 * | 12/2012 | Shteynberg et al. | 315/308 |
| 8,981,649 | B2 * | 3/2015 | Lee et al. | 315/122 |
| 2008/0116818 | A1 * | 5/2008 | Shteynberg et al. | 315/192 |
| 2010/0072903 | A1 * | 3/2010 | Blaut et al. | 315/185 R |
| 2011/0273103 | A1 * | 11/2011 | Hong | 315/193 |
| 2014/0125253 | A1 * | 5/2014 | Chen et al. | 315/307 |
| 2014/0265900 | A1 * | 9/2014 | Sadwick et al. | 315/200 R |
| 2014/0306615 | A1 * | 10/2014 | Choi et al. | 315/201 |
| 2014/0320007 | A1 * | 10/2014 | Stamm et al. | 315/51 |

* cited by examiner

*Primary Examiner* — Tuan T Lam

(74) *Attorney, Agent, or Firm* — Plager Schack LLP

(57) ABSTRACT

A LED light for replacing a fluorescent light in a fluorescent fixture is disclosed. The LED light is compatible with the existing fluorescent light fixture and ballast. The LED light includes a failure indicator to show whether a failure of the LED light is due to a failure of the ballast or a problem within the light. The LED light includes a color change mechanism, which may be controlled by an electromagnetic field or an input current to the LED light, thus making it compatible with current dimmer systems.

13 Claims, 5 Drawing Sheets

LED LIGHT BULB WITH FAILURE INDICATION AND COLOR CHANGE CAPABILITY

RELATED APPLICATIONS

This application claims priority to provisional patent application U.S. Ser. No. 61/656,522 filed on Jun. 7, 2012 and to provisional patent application U.S. Ser. No. 61/727,730 filed on Nov. 18, 2012, the entire contents of which are herein incorporated by reference.

BACKGROUND

The embodiments herein relate generally to light-emitted diode (LED) replacement lights designed for use in fluorescent lighting systems. The LED light may match the form factor, installation system, and operation of a fluorescent bulb. In addition, the LED light may include local failure detection, color changes functionality, or both.

As labor and inventory costs across the world are increasing and lighting systems becoming more complicated, it is increasingly important to provide the technicians who service these systems with indications to help them troubleshoot these devices. For example, with current fluorescent systems, when a fluorescent bulb stops illuminating, it is not apparent whether a fluorescent bulb has burned out or if the fluorescent ballast has failed. Troubleshooting this type of failure can become time consuming as the technician first has to gain access to the fluorescent fixture, which may require additional tools such as a ladder, cherry-picker or scaffolding, remove and replace the bulb, and finally identify whether the fluorescent bulb or the ballast has failed and replace accordingly.

Existing fluorescent bulb technology uses are limited to a single color of light emitted. If another color is desired, the bulb needs to be replaced with another color bulb.

Another common alternative of changing the emitted light color is to use a color sleeve to change the color of the bulb. However, this requires an agent to gain access to the fluorescent bulb, remove it, insert the color sleeve over the bulb and then replace the fluorescent bulb. Both of these options are costly and labor intensive.

LED replacement lights for fluorescent bulbs have been produced in the past. These replacement lights provide general illumination through the use of LEDs in a fixture that matches the existing form factor and electrical connections of a fluorescent bulb. However, current solutions do not incorporate a failure indicator to easily indicate if the source of an outage is a failure in the ballast or in the LED light itself. Current solutions do not protect the internal circuitry of an LED light from a ballast's strike voltage following the failure of one or more LEDs. Current solutions do not provide a color change capability using the existing dimming controls of fluorescent ballasts.

SUMMARY

One embodiment of the present disclosure includes a system for replacing a fluorescent light bulb with a light-emitting diode (LED) light bulb that is compatible with the existing fluorescent light ballast. The system includes a power connector, a first LED, a second LED, a sensor, and a failure LED. The power connector is configured to receive power from a fluorescent light ballast. The first LED is configured to produce a first color of light, and it is connected to the power connector. The second LED is configured to produce a second color of light, and it is connected to the power connector. The sensor is connected to the power connector and is configured to detect an electromagnetic field. The sensor is further configured to activate the first LED when an electromagnetic field is not detected. The sensor is still further configured to activate the second LED when an electromagnetic field is detected. The failure LED is configured to illuminate when at least one of the first LED and the second LED fails. The failure LED is connected to the power connector.

An additional embodiment of the present disclosure includes a system for replacing a fluorescent light bulb with a light-emitting diode (LED) light bulb that is compatible with the existing fluorescent light ballast. The system includes a power connector, a first LED, a second LED, a sensor, a microcontroller, and a failure LED. The power connector is configured to receive power from a fluorescent light ballast. The first LED is configured to produce a first color of light, and it is connected to the power connector. The second LED is configured to produce a second color of light, and it is connected to the power connector. The sensor is connected to the power connector and is configured to detect an electrical current. The sensor is further configured to produce a signal indicative of the level of the electrical current. The microcontroller is programmed to activate at least one of the first LED and the second LED in response to a signal received from the sensor. The microcontroller is connected to the first LED, the second LED, and the sensor. The failure LED is configured to illuminate when at least one of the first LED and the second LED fails. The failure LED is connected to the power connector.

BRIEF DESCRIPTION OF THE FIGURES

The detailed description of some embodiments of the present disclosure is made below with reference to the accompanying figures, wherein like numerals represent corresponding parts of the figures.

DETAILED DESCRIPTION OF CERTAIN EMBODIMENTS

Figure 1:
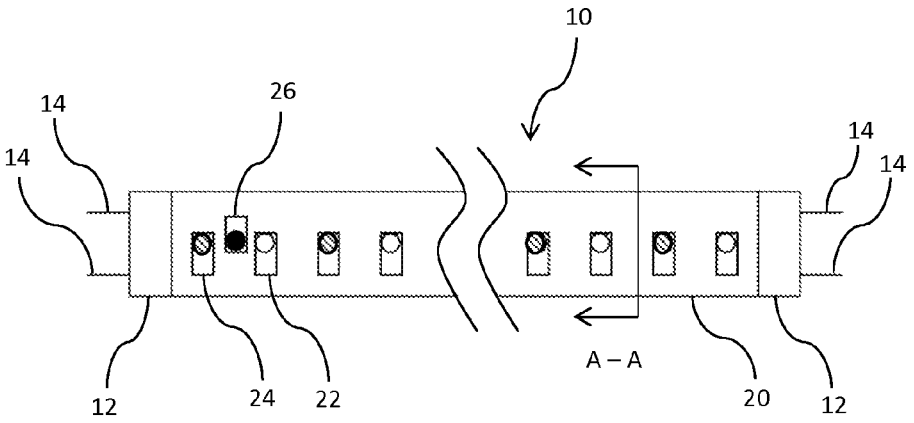
FIG. 1 shows a plan view of a linear LED replacement light, according to an embodiment of the present disclosure.

By way of example, and referring to FIG. 1, one embodiment of the present disclosure comprises a system for replacing a fluorescent bulb with an LED light 10. The light 10 may have a linear shape that matches the form factor of standard or common fluorescent bulbs. The light 10 may have a power connector 12 that is capable of connecting to an existing fluorescent lighting ballast. The power connector 12 may include one or more pins 14, which may connect to a printed circuit board (PCB) 16. The LED light 10 may include a housing 20. The housing 20 may include a thermally conducting layer, element, or material. A first LED 22, a second LED 24, and a failure indicator 26 may also connect to the PCB 16.

Figure 2:
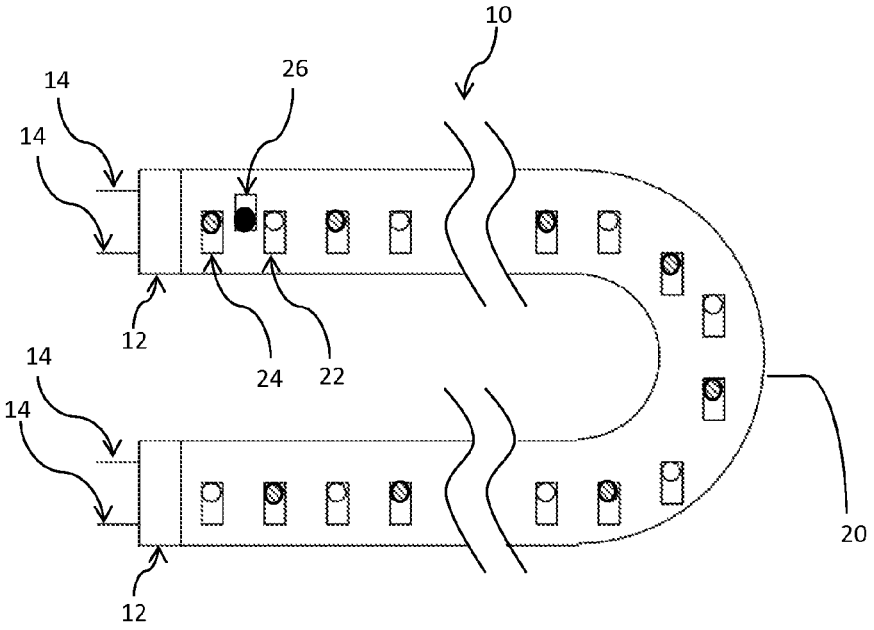
FIG. 2 shows a plan view of a U-shaped LED replacement light, according to an alternate embodiment of the present disclosure.

Referring to FIG. 2, the LED light 10 may have a curved or U-shaped configuration, which may match a form factor of standard or common fluorescent bulbs. As before, the light 10 may include a power connector 12 with one or more pins 14. The pins may be connected to a PCB 16. The light 10 may include a housing 20. The light 10 may also include a first LED 22, a second LED 24, and a failure indicator 26.

Figure 3:
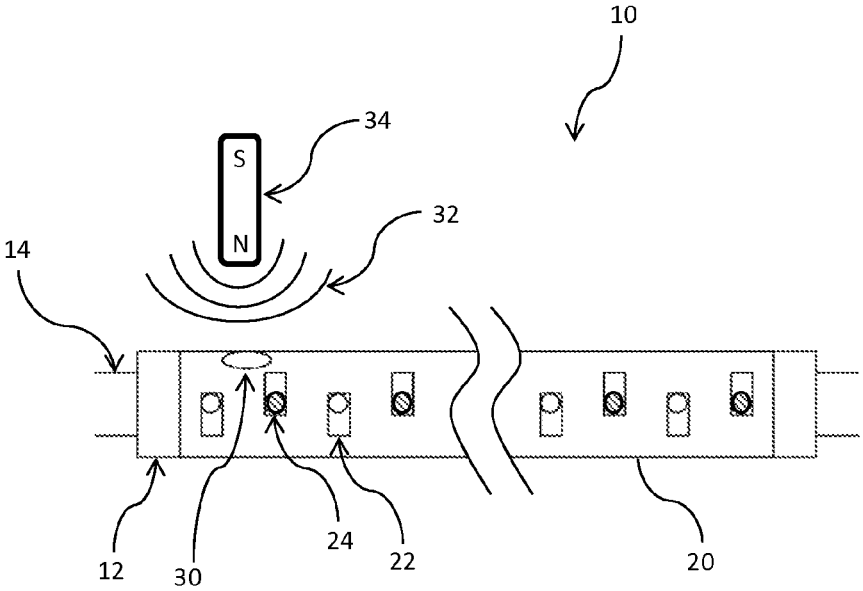
FIG. 3 shows a plan view of a magnet acting on the embodiment of FIG. 1.

Referring to FIG. 3, the LED light 10 may include a sensor 30 that may be sensitive to an electromagnetic field 32. For example, the sensor 30 may include a magnetic proximity switch, a Hall effect switch, or the like. The electromagnetic field 32 may include, for example, a magnetic field produced by a permanent magnet 34. Other mechanisms for producing the electromagnetic field 32 are well known in the art and may be used without departing from the spirit or scope of the present disclosure, including the claims.

Figure 4:
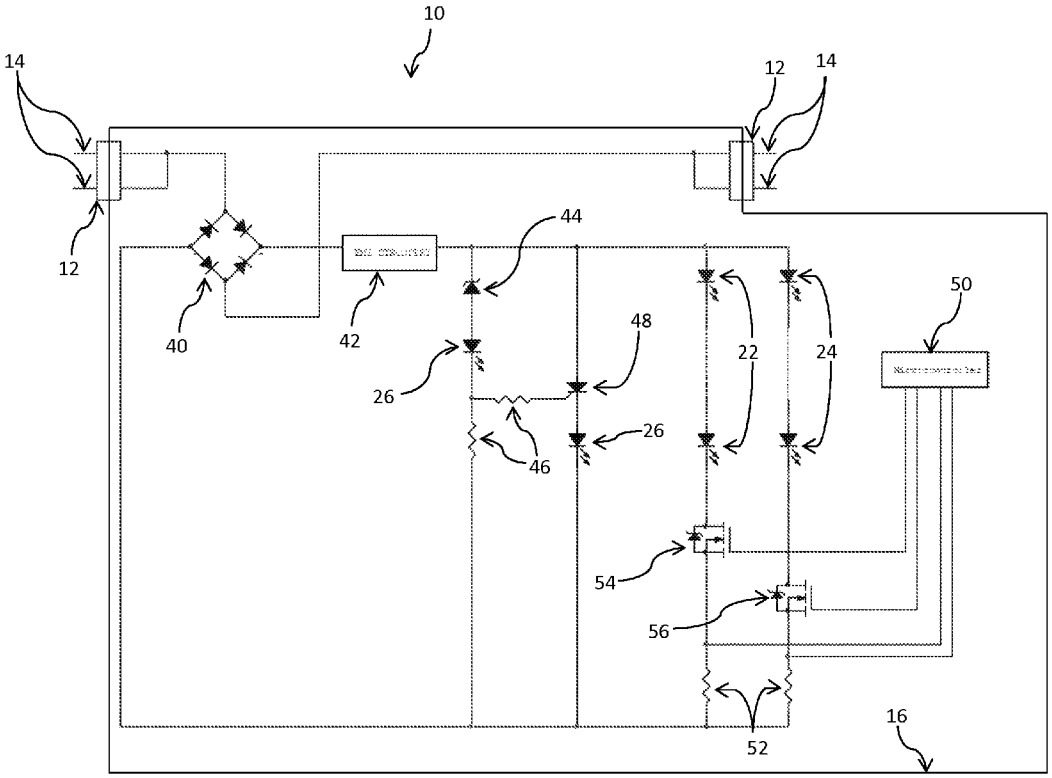
FIG. 4 shows a schematic view of color-change circuitry for an LED replacement light, according to an embodiment of the present disclosure.
Figure 5:
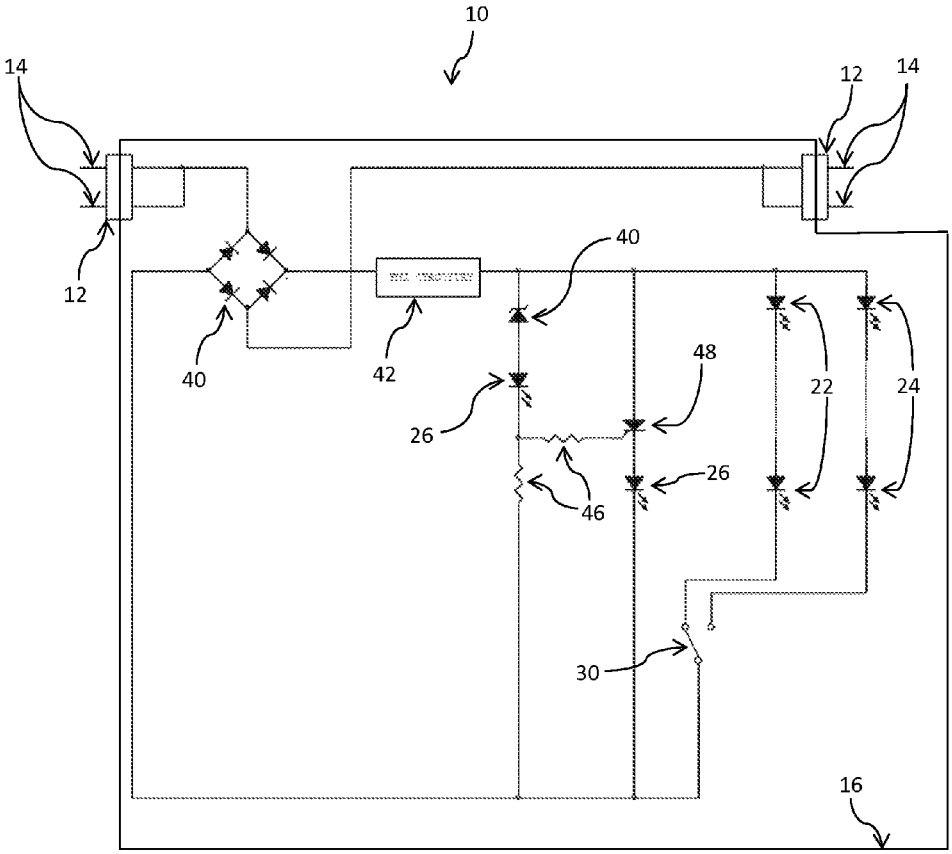
FIG. 5 shows a schematic view of color-change circuitry for an LED replacement light, according to an additional embodiment of the present disclosure.

Referring to FIGS. 4 and 5, the LED light 10 may include failure detection circuitry on PCB 16. Pins 14 may protrude through power connectors 12 to connect to a fluorescent lighting fixture (not shown). Under normal operating conditions, a bridge rectifier 40 may take the alternating current (AC) provided by, e.g., the fluorescent fixture's electronic or magnetic ballast. The rectifier 40 may rectifies the AC to direct current (DC), which may be used to illuminate the first LED 22. The first LED 22 may include two or more LEDs in series. Additionally electromagnetic interference (EMI) circuitry 42 may limit possible EMI effects and help to pass regulatory requirements.

The LED light 10 may include failure indication circuitry. The electronic or magnetic ballast of the fluorescent light fixture may provide a constant current AC source. If the first LED 22 or second LED 24 fails, all current flow may be stopped. This stoppage may cause the fluorescent ballast to begin stepping up the applied voltage to the LED light 10. A zener diode 44 may be set to breakdown at a voltage level higher than a working voltage of the first LED 22, the second LED 24, or both. The voltage of the zener diode 44 may be set to a level such that the diode 44 will only turn on when the voltage provided by the ballast exceeds the sum of the voltage stack-up of the nominal closed circuit components at their absolute maximum voltage ratings. The resistors 46 may be selected to adjust the current through each leg of the failure indication circuit, which may include the resistors 46, zener diode 44, the SCR 48, and the failure indication LED 26. Upon the fluorescent ballast stepping up the applied voltage to the LED light 10, the zener diode 44 may break down and trigger the SCR 48, thereby allowing current to pass through the failure indication LEDs 26 and the SCR 48. Thus, the failure indication LEDs 26 may be illuminated.

Figure 6:
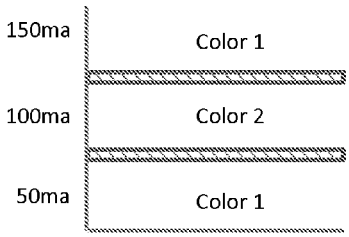
FIG. 6 shows an exemplary graph of the electrical current ranges which may be used to effect a color change in an LED replacement light, according to an embodiment of the present disclosure.
Figure 7:
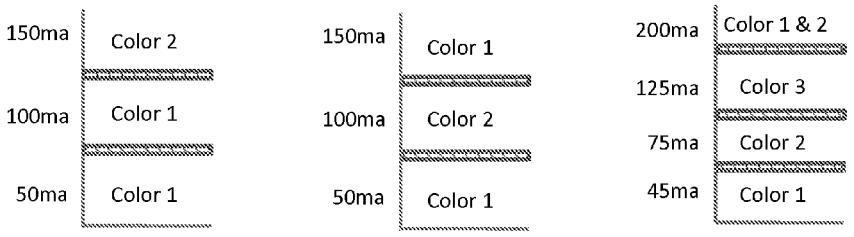
FIG. 7 shows additional exemplary graphs of electrical current ranges for effecting color changes in an LED replacement light, according to additional embodiments of the present disclosure.

Referring to FIGS. 4, 6, and 7, the LED light 10 may include a microcontroller 50 and a current sense resistor 52. The current sense resistor 52 may be in series with the first LED 22, and the resistor 52 may provide the microcontroller 50 with the exact current going through the first LED 22. The microcontroller 50 may compare the electrical current passing through the first LED 22 with a set of predetermined current ranges, such as those provided, e.g., in FIGS. 6 and 7. Based on this comparison, the microcontroller 50 may determine which LED, either first LED 22 or second LED 24, should be illuminated. To activate the first LED 22, for example, the microcontroller may activate a first transistor 54 that is in series with the first LED 22 and may deactivate a second transistor 56 that is in series with the second LED 24. To activate the second LED 24, for example, the microcontroller 50 may deactivate the first transistor 54 and activate the second transistor 56. If the first LED 22 and the second LED 24 have different colors, then changing the input current using a dimming switch may be used to change the color of the LED light 10. The LEDs 22, 24 may have different colors due to any suitable process, including, for example, LED color, color filters, color gels, and so on.

Referring to FIG. 5, the LED light 10 may include a sensor 30, such as, e.g., magnetic proximity switch, a Hall effect switch, or the like, as described above with respect to FIG. 3. The first LED 22 may include two or more LED lights arranged in series, and the second LED 24 may include two or more LED lights arranged in series. The presence of a permanent magnet 34 or electromagnetic field 32 near the sensor 30 may cause the LED light 10 to illuminate the second LED 24 while dimming or deactivating the first LED 22. Removing the permanent magnet 34 or electromagnetic field 32 may cause the LED light 10 to deactivate the second LED 34 and illuminate the first LED 22.

Figure 8:
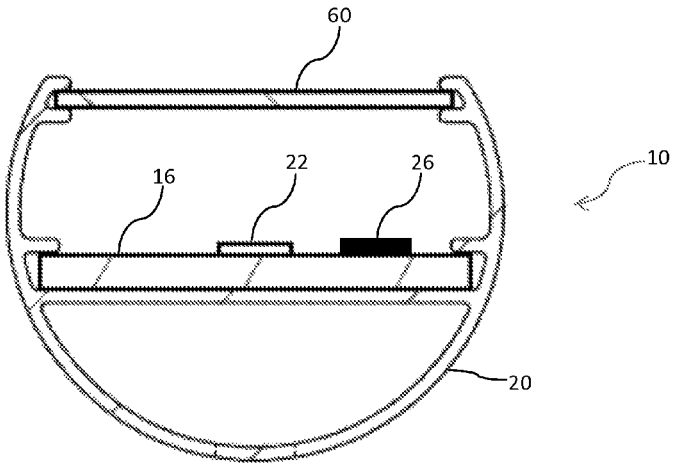
FIG. 8 shows a cross-section of the embodiment of FIG. 1 taken along line A-A.

Referring to FIG. 8, which shows an elevational view taken along line A-A in FIG. 1, the LED light 10 may include a housing 20. The housing 20 may have a circular or partial-circle cross-section, so that it may match a common fluorescent light form factor. The first LED 22, the second LED 24, and the failure LED 26 may be disposed on the PCB 16, which may be located within the housing 20. A lens assembly 60 may protect the components of the light 10 from damage, dust, and so on.

The LED light 10 may be used, for example, in retail stores. The color change capability could be used to change colors seasonally making store decorations easier and less costly. An advantage could be in retail store displays by changing color to attract attention when a case has been opened to prevent theft, or attract customer attention.

The LED light 10 may be used, as an additional example, within military vehicles, such as those requiring a night lighting setting. The light 10 would replace the two existing bulbs, which provide both normal illumination and night illumination, with a single fixture.

Persons of ordinary skill in the art may appreciate that numerous design configurations may be possible to enjoy the functional benefits of the inventive systems. Thus, given the wide variety of configurations and arrangements of embodiments of the present disclosure the scope of the present disclosure is reflected by the breadth of the claims below rather than narrowed by the embodiments described above.

What is claimed is:

1. A system for replacing a fluorescent light bulb with a light-emitting diode (LED) light bulb that is compatible with the existing fluorescent light ballast, the system comprising:

a power connector configured to receive power from a fluorescent light ballast;

a first LED configured to produce a first color of light, the first LED connected to the power connector;

a second LED configured to produce a second color of light, the second LED connected to the power connector;

a sensor connected to the power connector and configured to detect a magnetic field, the sensor further configured to activate the first LED when an electromagnetic field is not detected, the sensor still further configured to activate the second LED when an electromagnetic field is detected; and a failure LED configured to illuminate when at least one of the first LED and the second LED fails, the failure LED connected to the power connector.

2. The system of claim 1, wherein the sensor is configured to deactivate the second LED with the first LED is activated, and to deactivate the first LED when the second LED is activated.

3. The system of claim 1, wherein the first LED comprises a first plurality of LEDs connected in series, the first plurality of LEDs configured to produce the first color of light; and the second LED comprises a second plurality of LEDs connected in series, the second plurality of LEDs configured to produce the second color of light.

4. The system of claim 1, further comprising:

a zener diode configured to breakdown above a predetermined voltage level, thereby permitting current to reach the failure LED.

5. The system of claim 4, wherein the predetermined voltage level is indicative of a failure in at least one of the first LED and the second LED.

6. The system of claim 1, wherein the power connector comprises a fluorescent light pin and a printed circuit board.

7. A system for replacing a fluorescent light bulb with a light-emitting diode (LED) light bulb that is compatible with the existing fluorescent light ballast, the system comprising:

a power connector configured to receive power from a fluorescent light ballast;

a first LED configured to produce a first color of light, the first LED connected to the power connector;

a second LED configured to produce a second color of light, the second LED connected to the power connector;

a sensor connected to the power connector and configured to detect an electrical current, the sensor further configured to produce a signal indicative of the level of the electrical current;

a microcontroller programmed to activate at least one of the first LED and the second LED in response to a signal received from the sensor, the microcontroller connected to the first LED, the second LED, and the sensor; and a failure LED configured to illuminate when at least one of the first LED and the second LED fails, the failure LED connected to the power connector.

8. The system of claim 7, wherein the microcontroller is further programmed to deactivate the first LED in response to a signal received from the sensor and to deactivate the second LED in response to a signal received from the sensor.

9. The system of claim 7, wherein the first LED comprises a first plurality of LEDs connected in series, the first plurality of LEDs configured to produce the first color of light; and the second LED comprises a second plurality of LEDs connected in series, the second plurality of LEDs configured to produce the second color of light.

10. The system of claim 7, further comprising:

a zener diode configured to breakdown above a predetermined voltage level, thereby permitting current to reach the failure LED.

11. The system of claim 10, wherein the predetermined voltage level is indicative of a failure in at least one of the first LED and the second LED.

12. The system of claim 7, wherein the power connector comprises a fluorescent light pin and a printed circuit board.

13. The system of claim 7, wherein the sensor comprises a current sense resistor.

* * * * *